US006992260B1

(12) United States Patent
Cantolino

(10) Patent No.: US 6,992,260 B1
(45) Date of Patent: Jan. 31, 2006

(54) PLASTIC PAN FLOAT SWITCH AND MOUNTING SYSTEM ASSEMBLY

(76) Inventor: Christopher Ralph Cantolino, 4708 Manatee Ave. W., Bradenton, FL (US) 34209

( * ) Notice: Subject to any disclaimer, the term of this patent is extended or adjusted under 35 U.S.C. 154(b) by 0 days.

(21) Appl. No.: 11/124,952

(22) Filed: May 9, 2005

Related U.S. Application Data

(63) Continuation-in-part of application No. 10/932,967, filed on Sep. 2, 2004.

(51) Int. Cl.
*H01H 35/18* (2006.01)

(52) U.S. Cl. ..... 200/84 R

(58) Field of Classification Search ..... 73/305–309, 73/317–322.5; 200/84 R–84 C, 293; 338/33; 340/618–625
See application file for complete search history.

(56) References Cited

U.S. PATENT DOCUMENTS 3,176,707 A * 4/1965 Wilson ..... 73/322.5
4,183,176 A * 1/1980 Barfield ..... 73/317
4,345,879 A * 8/1982 Steiner ..... 200/84 C
4,757,305 A * 7/1988 Peso ..... 200/84 A
4,833,441 A * 5/1989 Okada et al. ..... 200/84 C
5,862,702 A * 1/1999 Liang ..... 200/84 C
6,513,378 B1 * 2/2003 Love, Jr. ..... 73/313
6,530,274 B1 * 3/2003 Philbeck ..... 73/314
6,681,627 B1 * 1/2004 Li ..... 200/84 C
6,730,865 B1 * 5/2004 Hernandez-Zelaya ..... 200/84 R

* cited by examiner

*Primary Examiner*—Michael A. Friedhofer
(74) *Attorney, Agent, or Firm*—Dorothy S. Morse

(57) ABSTRACT

A float switch, housing, and clamping member assembly that is made from plastic and impervious to corrosion, with improvements over the prior art including a wide float switch body for enhanced water displacement that results in a more responsive operation, a housing configured to protect its float switch body from malfunction due to airborne debris, a clamping member configured to create a J-shaped slot between it and the housing when they are connected together over the upper edge of a support surface, such as a plastic condensate collection pan with a flange. Oversized thumbscrews facilitate and expedite installation. Strength-enhancing ribs are associated with the housing and clamping member. Connection between the housing and clamping member can also include a ratcheting configuration.

14 Claims, 20 Drawing Sheets

PLASTIC PAN FLOAT SWITCH AND MOUNTING SYSTEM ASSEMBLY

CROSS-REFERENCES TO RELATED APPLICATIONS

This application is a continuation-in-part of still pending U.S. Ser. No. 10/932,967 filed by the same inventor for substantially the same subject matter on Sep. 2, 2004, with improvements over the invention disclosed in parent application Ser. No. 10/932,967 that primarily include a two-part housing/clamp structure that creates a J-shaped slot which is able to accommodate a variety of plastic condensate collection pans having different upper edge configurations, that optionally can includes a ratcheting arrangement between the clamping member and the housing to better secure the upper edge of a plastic condensate collection pan within the J-shaped slot, that has ribs which add strength to the housing and clamping member, and that has a rearward location in the housing for its air vent holes which make them less likely to become clogged with water, algae, and/or debris.

BACKGROUND OF THE INVENTION

1. Field of the Invention

This invention relates to liquid-level float switches, specifically to a float switch and mounting system assembly of sturdy construction that is primarily contemplated for use in condensate collection applications where a plastic pan is present, but which is also useful in a variety of other applications. The most preferred embodiment of the present invention comprises an adjustable float switch body with the amount of its vertical movement relative to a concentrically positioned shaft being adjustably defined by an upper locknut and a disk-shaped bottom stop that are both connected to the shaft, with the float switch body also having a large surface area for enhanced buoyancy and responsive operation; a housing configured and positioned to protect float switch body movement from interference due to airborne debris, with the housing being closely positioned around the float switch body and having an open bottom end, the housing also having a threaded aperture centrally through its top surface that is configured for aligning the upper end of the shaft as it guides the vertical displacement of the float switch body within the housing, and the housing further having at least one air vent opening through its rear portion that is configured and dimensioned to prevent float switch body malfunction as a result of an airlock created by fluid entering the housing through its open bottom end; the two-part housing/clamp structure in combination with a clamping means creating an inverted J-shaped slot configured for being positioned over the upper edge of a vertically-extending support surface, such as a plastic pan, with the rear portion of the housing forming one side of the slot and the clamping member forming the other side of the slot and the curved upper surface connecting the sides of the slot, the clamping member also preferably having at least two horizontally-extending threaded bores therethrough each being configured for the engagement of one thumbscrew used for tightening the clamping member against a support surface positioned within its slot, and optionally comprises a ratcheting arrangement that further assists in adjusting the width of the J-shaped slot for a secure connection of the two-part housing/clamp structure to its support surface and further stabilize the installed housing/clamp structure to prevent changes in its orientation that could diminish float switch body function.

2. Description of the Related Art

When air conditioning condensate and other condensates are collected, there is often a risk of overflow or back-up into the system producing it. As a result, liquid-level float switches have been employed with collection pans to shut-off the source of condensate flow when the amount of fluid collected exceeds a predetermined depth. However, currently known float switches are deficient in many ways and thereby subject to malfunction, less responsive operation, more costly installation, and/or unstable installation. First, the collection pans used for condensate collection do not always have a sturdy construction. Therefore, when the upstanding pan wall to which a float switch is attached bends as a result of the switch mounting, the float switch tends to lean in over time and when it does it is no longer mounted in a level orientation, making it less responsive. Also, the plastic pans used can have varying upper edge configurations and a mounting bracket that securely attaches a switch/housing to one pan so as to achieve proper float switch function, may not be able to securely attach the float switch to a pan with a different upper edge thickness or configuration. Further, depending upon the location of the collection pan, a float switch mounted thereto may be at risk for malfunction as a result of airborne debris, such as but not limited to the insulation fibers often encountered in attics where air conditioning system condensing units are located. Also, prior art liquid-level float switches tend to have float switch bodies that wobble relative to the shaft with which they are associated, a condition that can lead to less responsive operation or malfunction. Typically, also, the installation of prior art float switches requires the drilling of at least one hole through the support surface or pan, which increases installation cost. In addition, some float switches are at risk for premature malfunction as a result of being made from materials that are not completely corrosion-resistant. In contrast, the present invention is made from plastic that is impervious to corrosion. Its float switch body is wider than those of known prior art float switches for greater water displacement and a faster response, and it contains a housing that protects its float switch body from malfunction due to airborne debris. In addition, it has at least two thumbscrews to facilitate and expedite clamping member installation in a manner where no drilling is required, as well as a two-part housing/clamp structure that can optionally include a ratcheting arrangement between clamping member and housing for adjustable and better securing of the device to plastic pans. Further, a plurality of spaced-apart ribs add strength to the present invention housing and clamping member, and relocation of air vent holes from the top surface to the rear portion of the housing protects them and makes them less likely to clog with water, algae, and/or debris for continued proper operation of the float switch body within the housing.

BRIEF SUMMARY OF THE INVENTION—OBJECTIVES AND ADVANTAGES

The primary object of the present invention is to provide a float switch and mounting system assembly for use with plastic condensate collection pans to shut-off condensate flow when the amount collected exceeds a predetermined depth. It is also an object of the present invention to provide a float switch and mounting system assembly that has cost-effective construction for widespread distribution and use. It is a further object of the present invention to provide a float switch that is sturdy in construction for responsive and reliable operation. A further object of the present invention to provide a float switch and mounting system assembly designed for prompt and cost effective installation. It is also an object of the present invention to provide a float switch and mounting system assembly that is adjustable and capable of being securely installed and thereafter remain substantially in its original orientation during its entire period of use. Another object of the present invention is to provide a float switch and mounting system assembly with a design that compensates for insubstantial condensate collection pan construction, to prevent the float switch body from leaning in during use. A further object of this invention is to provide a float switch and mounting system assembly that has a means of self-protection against malfunction due to airborne debris, such as the loose insulation fibers typically encountered in attics with some air conditioning applications. In addition, it is a further object of the present invention to provide a float switch and mounting system assembly that is made from corrosion-resistant materials that resist premature deterioration and malfunction.

As described herein, properly manufactured and used, the present invention would provide a float switch and mounting system assembly that can be used to shut-off the flow of condensate or other fluid when the amount of it collected in a pan or other container associated with the present invention reaches a pre-determined maximum depth. The present invention is typically made from plastic, and is thereby impervious to corrosion, which in combination with its sturdy construction avoids premature deterioration. Also, its float switch body is wider than prior art float switches for greater water displacement, and it contains a housing that protects its float switch body from malfunction due to airborne debris, both of which contribute to a more responsive and reliable operation than is possible with other float switches proposed in the prior art that are capable of fulfilling the same function. In addition, it has a two-part housing/clamp structure with an inverted J-shaped slot and preferably at least two thumbscrews that facilitate and expedite installation, and since the amount of vertical float switch body displacement is also adjustable, the present invention is readily adaptable to a wide variety of applications and changing needs. Further, the thumbscrews provided that prevent the need for drilling holes in a support surface make installation of the present invention efficient and cost-effective, and the design of the present invention that includes multiple spaced-apart ribs in both the clamping member and housing provides sturdy and cost-effective construction. In addition, installation of the present invention via its slot, thumbscrews, and an optional ratcheting arrangement between the housing and the clamping members provides for secure connection of the present invention to a support surface, even when the support surface is uneven or of varying thickness, with the wide and upwardly-extending clamping member J-shaped slot compensating for weak condensate collection pan construction so as to prevent the float switch body from leaning in during use and potentially becoming less responsive. Also, the housing protects the float switch body against malfunction due to contact with airborne debris, such as but not limited to the loose insulation fibers that are often encountered in attics during air conditioning applications. Further, placement of the air hole or holes through the protected rear portion of the housing make them less likely to become clogged during use and facilitate float switch body movement by preventing airlock.

Although the description herein provides preferred embodiments of the present invention, it should not be construed as limiting the scope of the present invention float switch and mounting system assembly. For example, variations in the height and diameter of the shaft used for float switch body movement; the number of threads used on the upper portion of the shaft for connection with the housing; the size, number, configuration and spaced-apart location of the air vent openings in the rear portion of the housing; the size, location, number, and spaced-apart location of the thumbscrew openings in the clamping member, the depth and width of the upwardly-extending J-shaped slot; the number, location, configuration, and relative spacing of the structural housing and clamping member ribs; the number and orientation of the frictional ribs and tongue preferably used as a part of the ratcheting arrangement; the comparative height dimensions of the housing and the clamping member; the relative height dimensions of the float switch body, housing, and shaft; the configuration and dimension of the housing as long as it allows for unrestricted vertical float switch body movement without unnecessary material expense; the configuration and dimension of the means used to secure the housing and clamping member together; and the perimeter configuration and dimension of the lock-nut used to tighten the shaft to the housing; in addition to those variations shown and described herein, may be incorporated into the present invention. Thus, the scope of the present invention should be determined by the appended claims and their legal equivalents, rather than being limited to the examples given.

DETAILED DESCRIPTION OF THE INVENTION

While FIGS. 1–20 show the most preferred embodiment of the present invention, it is to be understood that many variations in the present invention are possible and also considered to be a part of the invention disclosed herein, even though such variations are not specifically mentioned or shown. As a result, a reader should determine the scope of the present invention by the appended claims.

Figure 1:
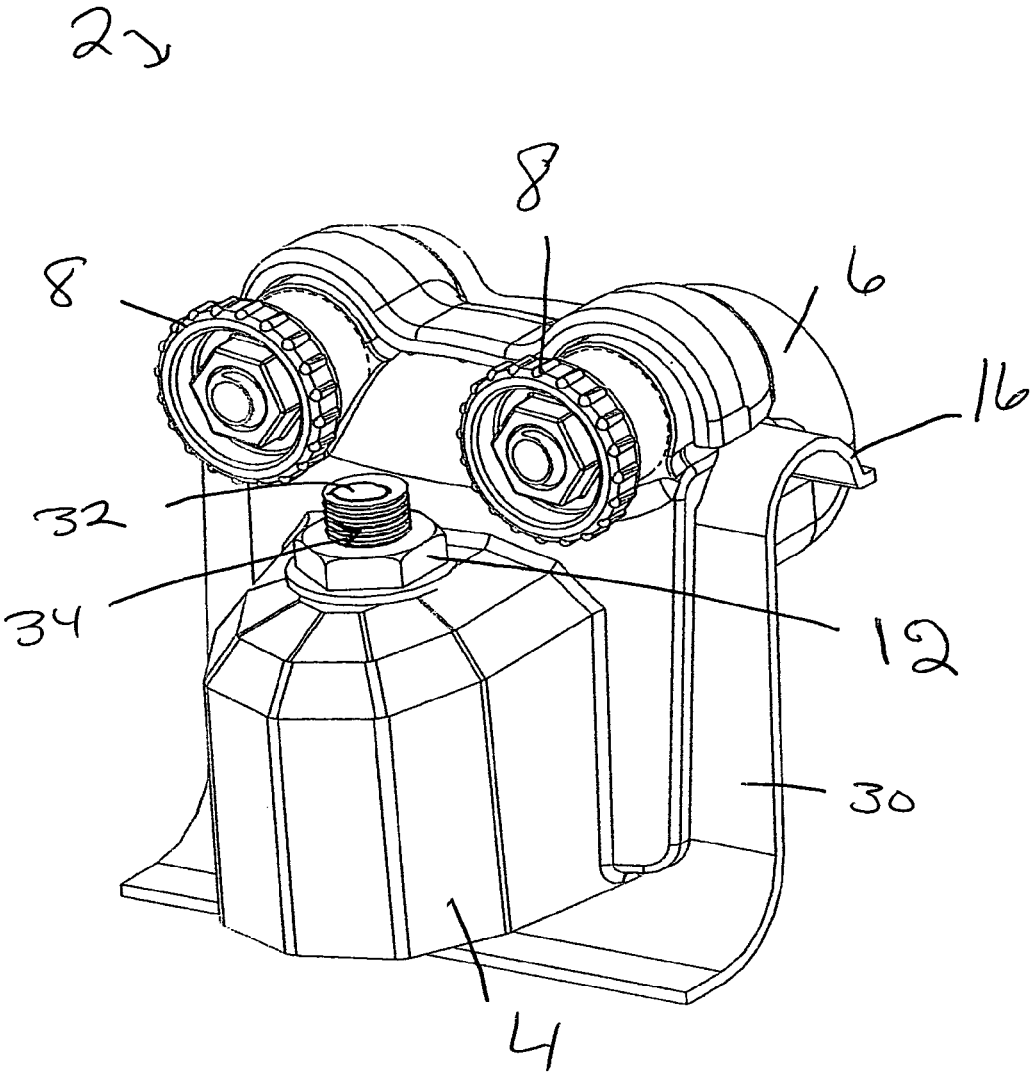
FIG. 1 is a perspective front view of the most preferred embodiment of the present invention having a two-part housing/clamp structure that is attached to a segment of a vertically-extending support surface, such as the upper edge of a plastic condensate pan.

FIG. 1 shows the most preferred embodiment 2 of the present invention having a protective housing 4, a vertically-oriented shaft (identified in FIG. 9 by the number 10) that is secured centrally through the top surface of protective housing 4 by a lock-nut 12 and with shaft 10 having a top opening 32 and a threaded upper end 34. FIG. 1 also shows a clamping member 6 attached to housing 4 via two nuts 8. Although the two nut 8 configuration is preferred, housing 4 and clamping member 6 could be configured for connection with more or less than the two nuts 8 shown in FIG. 1. FIG. 1 further shows a section of the wall and bottom surface of a support surface 30, such as but not limited to a condensate collection pan, with a portion of the upstanding wall thereof and its outwardly extending arcuate flange 16 positioned between housing 4 and clamping member 6. Although FIG. 1 shows the height dimension of housing 4 as being sufficient to completely cover the float switch body 18 positioned within it, the height dimension of housing 4 is not critical and can be greater or less than that shown in FIG. 1, as long as housing 4 is sufficiently large to fulfill its primary function of protecting float switch body 18 from malfunction due to interference by airborne debris (not shown). As can be clearly seen in FIG. 9, but not visible in FIG. 1, housing 4 has an open bottom end and float switch body 18 is positioned around shaft 10 and concentric to it, being guided for vertical movement within housing 4 between the lower lock-nut 12 and disk-shaped stop 22 by the non-threaded lower portion of shaft 10, and such movement being in response to changing fluid depth in the collection container or pan 30 that has its top edge secured between housing 4 and clamping member 6. Although not visible in FIG. 1, but visible in FIG. 17, at least one air vent opening 14 is used through the rear portion of housing 4 to prevent airlock and potential malfunction of float switch body 18 as rising water moves upwardly into housing 4 through its open bottom end. FIG. 1 further shows clamping member 6 having a greater height dimension than housing 4, with the surplus height extending upwardly beyond the upper surface of housing 4. The respective height dimensions of clamping member 6 and housing 4 are not critical, and either could be greater or less than that shown in FIG. 1 as long as they provide a sturdy connection to the upper portion of a fluid collection container or pan. Although not shown in FIG. 1, during the operation of the present invention the upper end of shaft 10 would have a pair of lead wires 38 extending upwardly from the top opening 32 in shaft 10. When lead wires 38 are connected into the circuit of the system generating the fluid to be collected in the container or pan 30 to which preferred embodiment 2 is attached, rising fluid collected in the container or pan 30 will cause the present invention float switch body 18 to similarly rise, and when the depth of the collected fluid reaches a pre-determined height, the system's circuit will either be interrupted or completed so as to suspend the generation of additional fluid.

Figure 2:
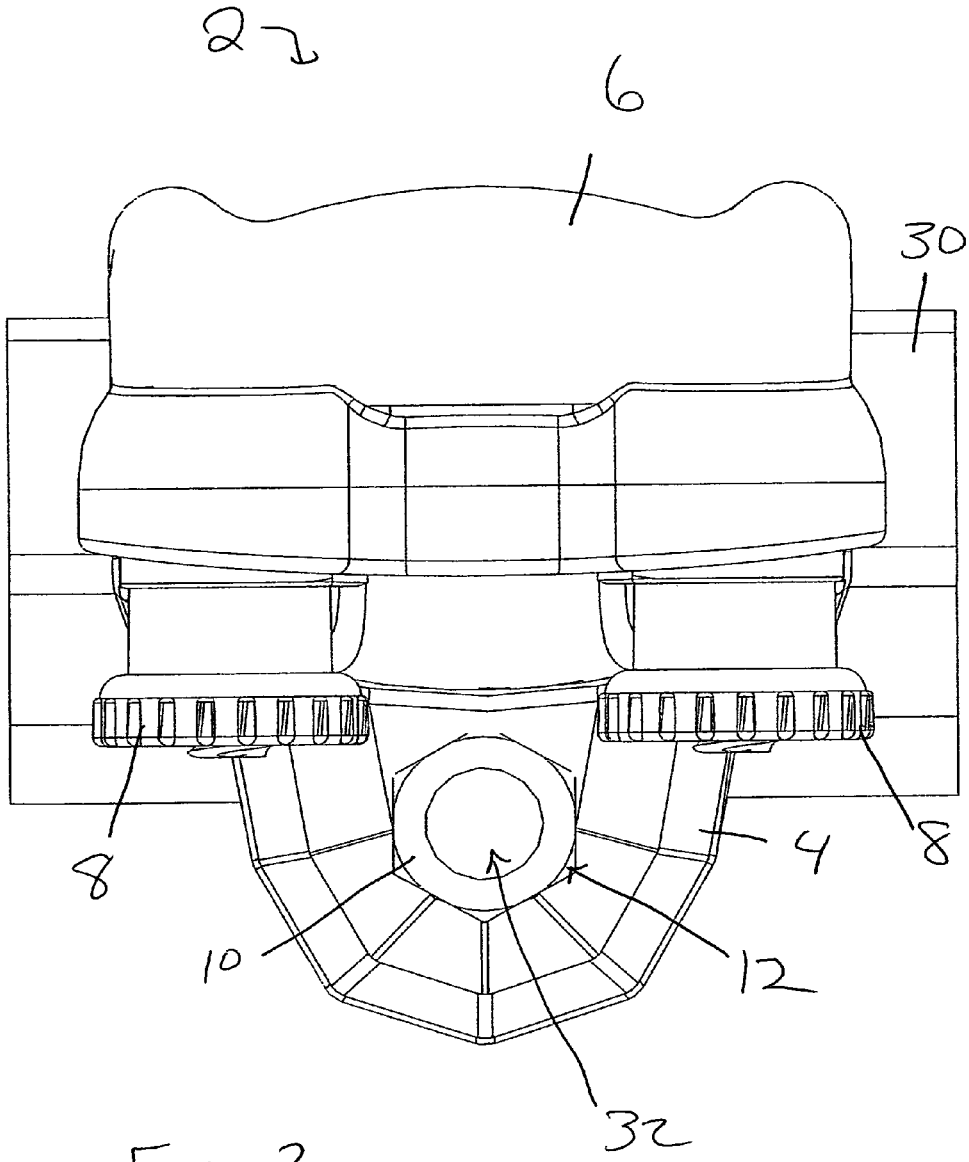
FIG. 2 is top view of the most preferred embodiment of the present invention having a two-part housing/clamp structure that is attached to the upper edge of a vertically-extending support surface.

FIG. 2 shows the most preferred embodiment 2 of the present invention having a housing 4 with a half-dodecagon shape, a vertically-oriented shaft 10 centrally through the top surface of protective housing 4 and secured by a lock-nut 12, and clamping member 6 in an opposed position from housing 4 and connected thereto via two nuts 8. The upper portion of a supper surface 30 is positioned between housing 4 and clamping member 6. The dodecagon shape of housing 4 gives it more strength and thereby allows manufacture of housing 4 with thinner walls and less material cost than would be required with alternative configurations such as that of a cylinder, while providing equivalent protection of float switch body 18 to the thicker walled configurations. The angled shape of the upper surface of housing 4 is also configured to minimize the accumulation of water and/or debris thereon. Below the large rear portion of clamping member 6 (to which the numeral 6 is attached), although hidden from view in FIG. 2, at least two thumbscrews 28 are connected to clamping member 6 in a position remote from housing 4 and used to secure clamping member 6 to a support surface, such as but not limited to the upper portion of the upstanding wall of the collection pan 30 shown in FIGS. 1 and 2. Although FIG. 2 shows shaft 10 having a hollow top opening 32, the lead wires 38 that would typically extend from top opening 32 have been omitted for clarity of illustration. Further, although FIG. 2 shows housing 4 and clamping member 6 having no surface texture, it is contemplated for each to have any texture or decorative enhancement that does not interfere with its function.

Figure 3:
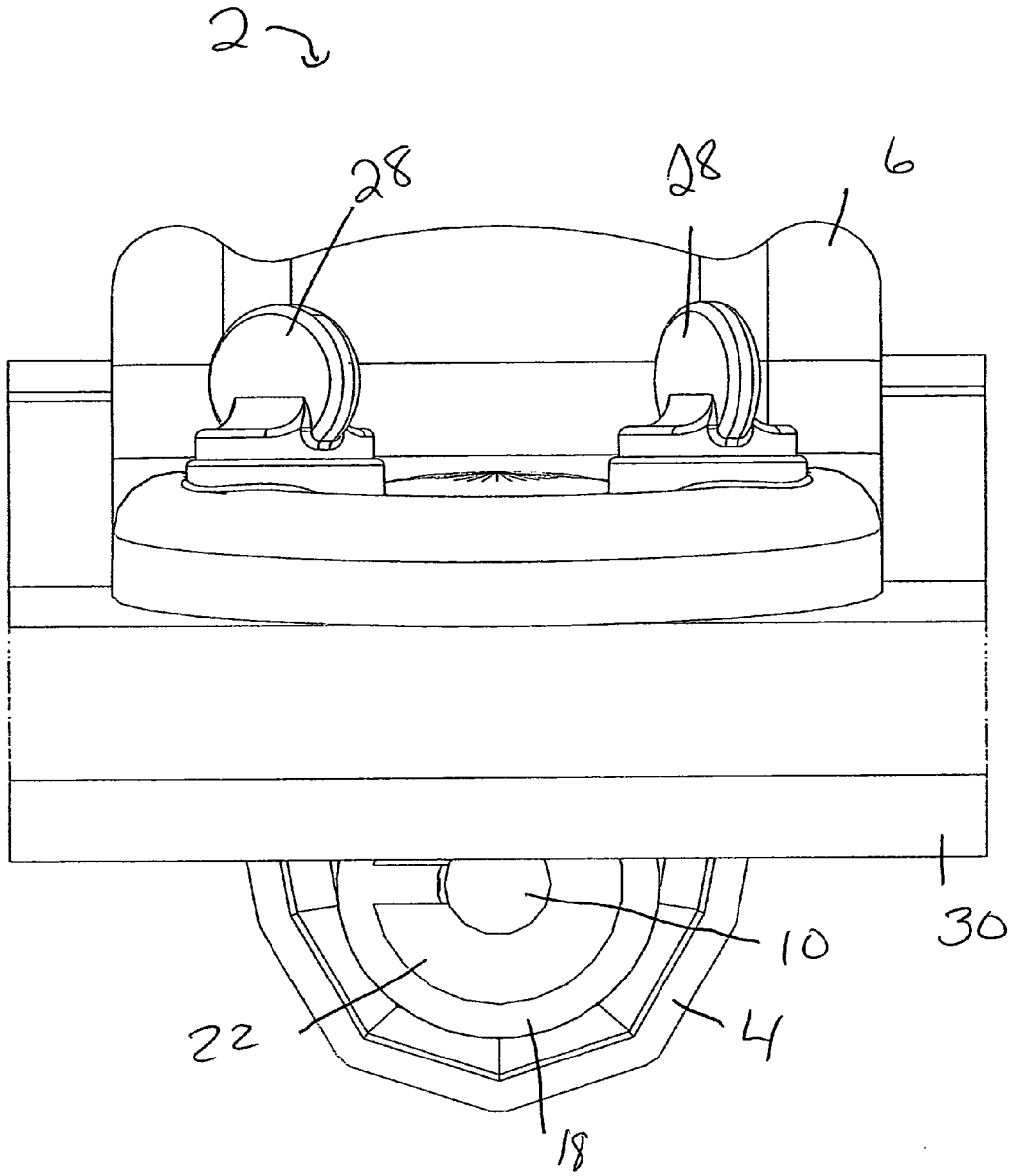
FIG. 3 is bottom perspective view of the most preferred embodiment of the present invention having a two-part housing/clamp structure that is attached to a vertically-extending support surface such as a plastic condensate pan, with a float switch body concentrically positioned within the housing, the housing closely positioned around the float switch body to retain the float switch body on the shaft, a disk-shaped stop attached to the lower end of the shaft below the float switch body, and two thumbscrews securing the support surface within the slot between housing and clamping member.
Figure 4:
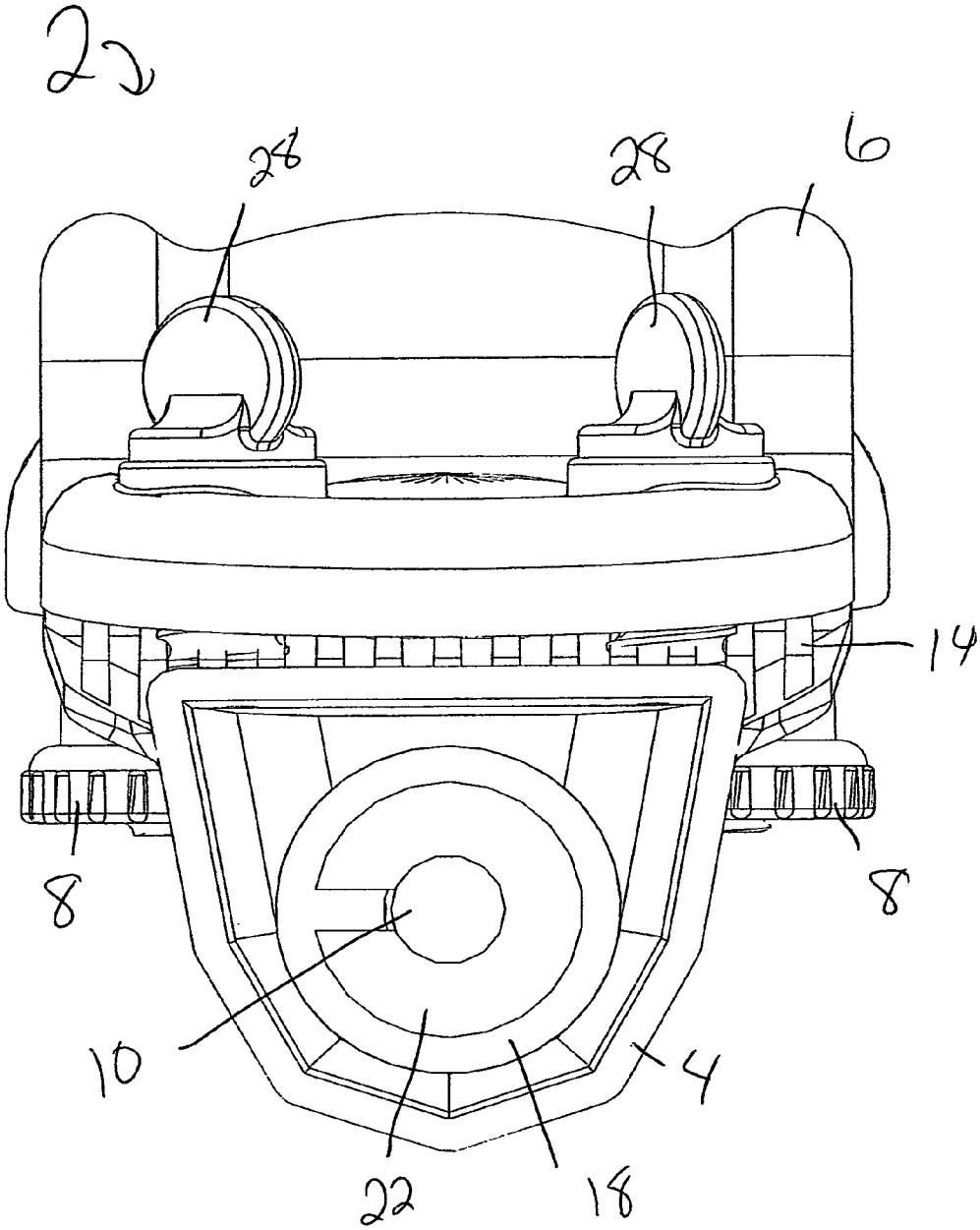
FIG. 4 is bottom view of the most preferred embodiment of the present invention without the support surface inserted into the slot.

FIGS. 3 and 4 show the most preferred embodiment 2 of the present invention having a protective housing 4 with an open bottom end through which float switch body 18 and stop 22 are viewed. FIG. 3 shows preferred embodiment fixed to a support surface 30, while FIG. 4 shows support surface 30 omitted and a plurality of ribs 14 visible. Ribs 14 assist in the venting of air from housing 4 to prevent airlock malfunction of float switch body 18 during its vertical movement within the half-dodecagon configuration (identified by the number 26 in FIG. 8) of housing 4. A shaft 10 is centrally positioned within housing 4, with a float switch body 18 also being positioned within housing 4 concentrically around shaft 10. A disk-shaped stop 22 is attached to the lower end of shaft 10, below float switch body 18 to function as a lower boundary for float switch body 18 movement. Preferred embodiment 2 comprises two main components, housing 4 and clamping member 6, which are separable from one another by the release of nuts 8. A configuration of housing 4 and clamping member 6 that uses two nuts 8 is preferred, although not critical. When connected together by nuts 8, housing 4 and clamping member 6 create a J-shaped space that accommodates the prompt and secure insertion of the upper portion of a condensate collection pan or other support surface 30 within the J-shaped slot. No drilling of a hole in upper portion of a condensate collection pan or other support surface 30 is required during installation or use of preferred embodiment 2. Two thumbscrews 28 extend through the clamping member 6 and assist in maintaining preferred embodiment 2 in a fixed and secure position relative to support surface 30. Also in FIGS. 3 and 4, the manipulated ends of the thumbscrews 28 appear large relative to clamping member 6, with the large configuration shown being preferred to facilitate ease of use. It is not contemplated for the number of thumbscrews 28 in preferred embodiment 2 be limited to that shown in FIGS. 3 and 4. Further, although the half-dodecagon configuration is preferred, housing 4 may have any cross-sectional configuration as long as that of float switch body 18 complements it for unimpaired upward and downward movement according to rising water levels in the associated condensate collection pan 30.

Figure 5:
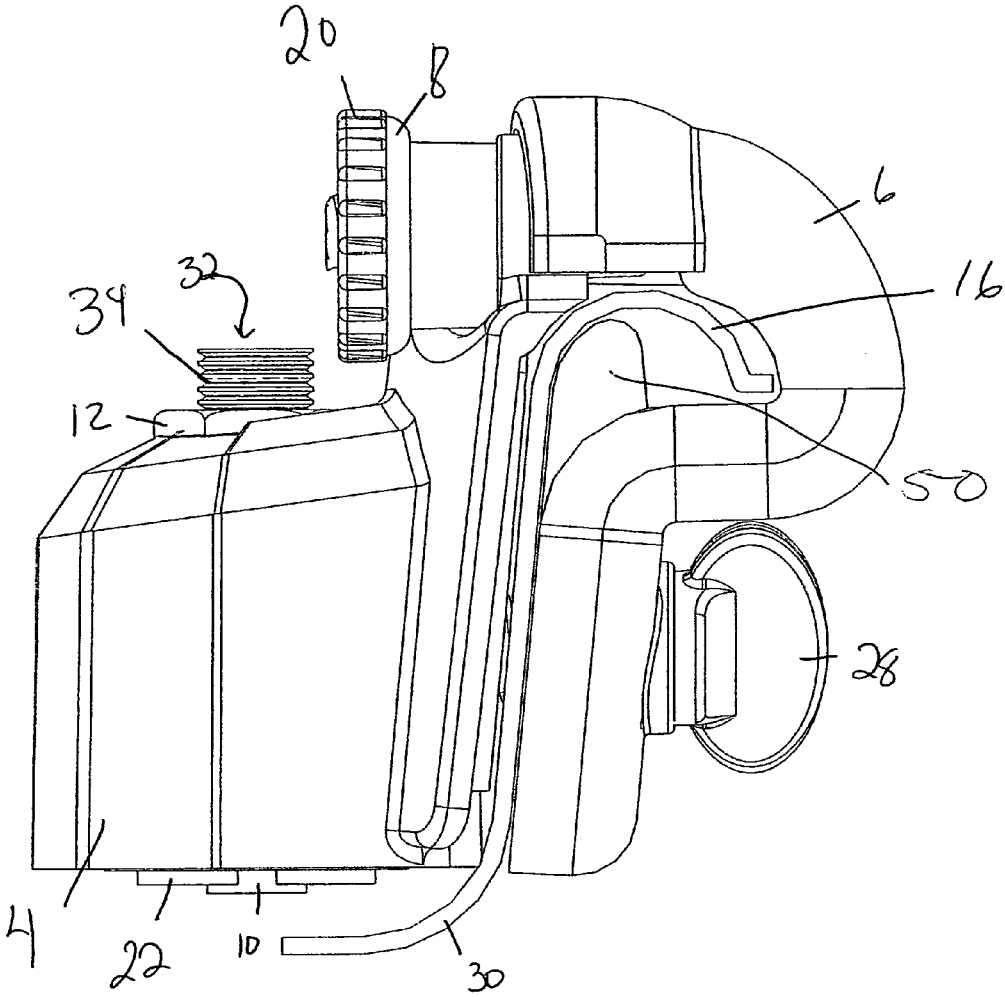
FIG. 5 is a side view of the most preferred embodiment of the present invention having a two-part housing/clamp structure that is attached to a vertically-extending support surface, a J-shaped slot formed between the housing and the clamping member, the threaded top portion of a shaft extending above the housing, a disk-shaped stop attached to the lower end of the shaft that defines the lower boundary of float switch body movement, and a thumbscrew connected through the clamping member and extending into the slot for use in securing the upper portion of a support surface within the slot.
Figure 6:
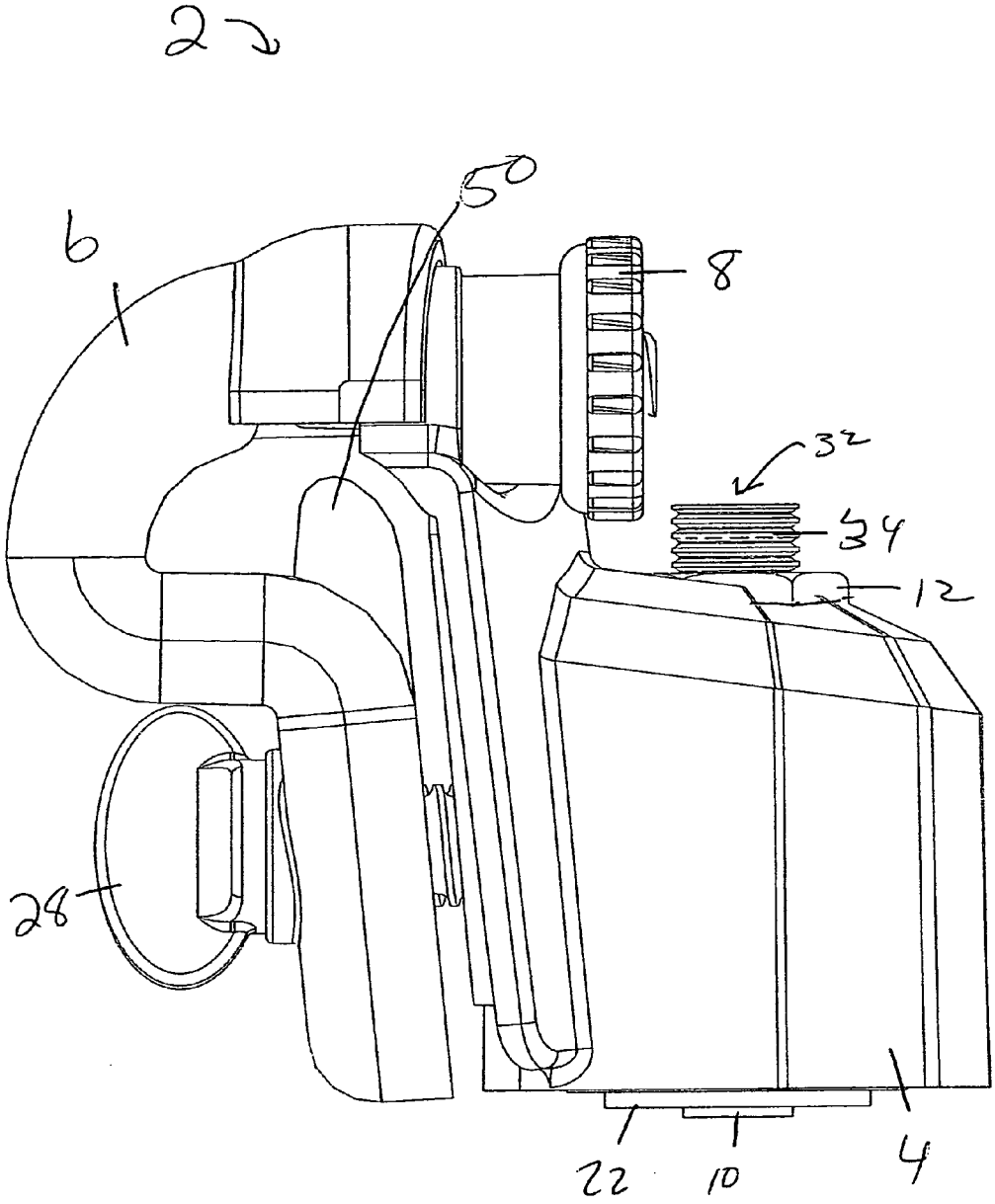
FIG. 6 is a side view of the most preferred embodiment of the present invention without the support surface inserted into the slot.

FIGS. 5 and 6 show the most preferred embodiment 2 of the present invention having a J-shaped slot between housing 4 and clamping member 6, with housing 4 secured to clamping member 6 via two nuts 8. Although not critical, it is preferred that nuts 8 have an outer configuration with easily gripped protrusions 20 that allow it to be easily picked up and manipulated during installation. Positioned between housing 4 and clamping member 6, FIG. 5 shows the upper portion of a condensate collection pan or other support surface 30, while FIG. 6 shows no support surface 30. FIGS. 5 and 6 further show housing 4 substantially covering the float switch body 18 inside it, to keep airborne debris (not shown) from preventing the proper and uninhibited vertical movement of float switch body 18. Only the stop 22 and the shaft 10 to which stop 22 is attached are visible below housing 4. The disk-shaped stop 22 is secured near to the lower end of shaft 10. However, by raising and lowering stop 22 relative to shaft 10, stop 22 can be used as a means of adjusting the maximum vertical displacement of float switch body 18 according to a specific application or need. In the alternative, although not shown, one or more additional stops 22 with the same or different thickness dimension could be used in addition to, or in place of the stop 22 shown in FIGS. 5 and 6, as an alternative means of vertical displacement adjustment. When the upper portion of a fluid collection pan or other upstanding support surface 30 is inserted into the J-shaped slot between housing 4 and clamping member 6, thumbscrews 28 are advanced toward the upper portion of support surface 30 until they each firmly engage the support surface 30 and provide a secure connection between support surface 30, clamping member 6, and housing 4. At least two thumbscrews 28 are typically used for securely positioning clamping member 6 and housing 4 so that the float switch body 18 within housing 4 can operate without wobbling or other interference that could adversely affect its condensate shut-off triggering function. The side projections 50 shown in FIGS. 5 and 6 further assist the thumbscrews 28 in retaining the upper portion of support surface 30 within the J-shaped slot between housing 4 and clamping member 6. Although FIGS. 5 and 6 show the upper surface of clamping member 6 extending above the top surface of housing 4, the relative sizes of housing 4 and clamping member 6 are not critical or limited to that shown in FIGS. 5 and 6, as long as each is sufficiently large to fulfill its intended function without undue material waste.

Figure 7:
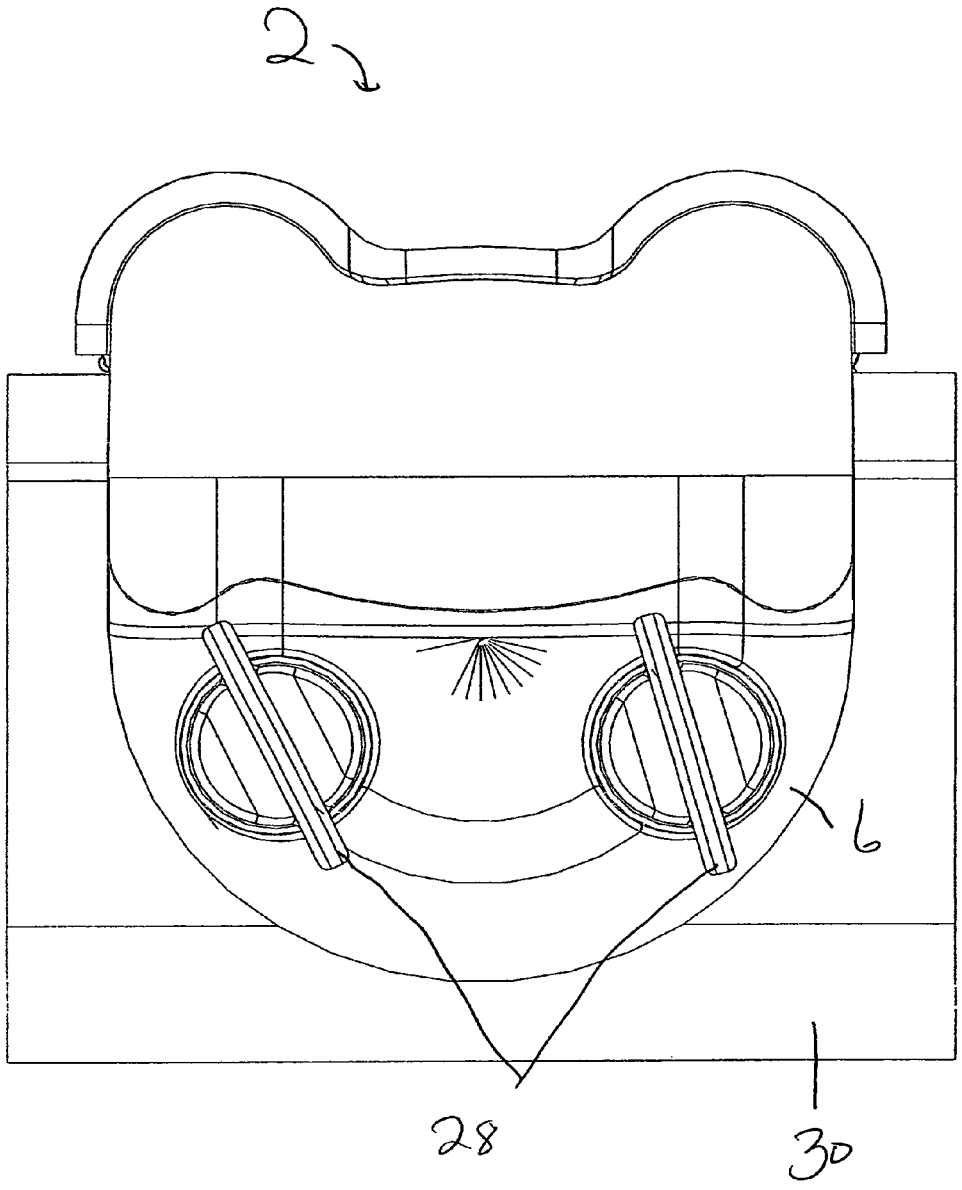
FIG. 7 is a rear view of the most preferred embodiment of the present invention with the support surface inserted into the slot and two thumbscrews inserted through the clamping member for securing the housing/clamp structure and float switch body in a stable and fixed position relative to the support surface.

FIG. 7 shows most preferred embodiment 2 of the present invention having clamping member 6 attached to a decagon-shaped housing 4, with a support surface 30 connected between them. Housing 4 is positioned behind clamping member 6 and is not visible in FIG. 7. Two thumbscrews 28 are shown inserted through clamping member 6 and used to firmly engage support surface 30 and provide a secure connection between support surface 30, clamping member 6, and housing 4. The number of thumbscrews 28 used is not critical and for many applications the use of the two laterally spaced-apart thumbscrews 28 shown in FIG. 7 is sufficient. Also, thumbscrews 28 are not limited in size, shape, location, or surface texture, and as long as they are easily gripped and manipulated for prompt installation of preferred embodiment 2 to a support structure, any desired size, shape, location, and surface texture can be used. However, in determining the size, number, shape, location, and/or surface texture of thumbscrews 28, as in all aspects of present invention structure and design, it is preferred that the material cost relating thereto only be increased where additional benefit is derived.

Figure 8:
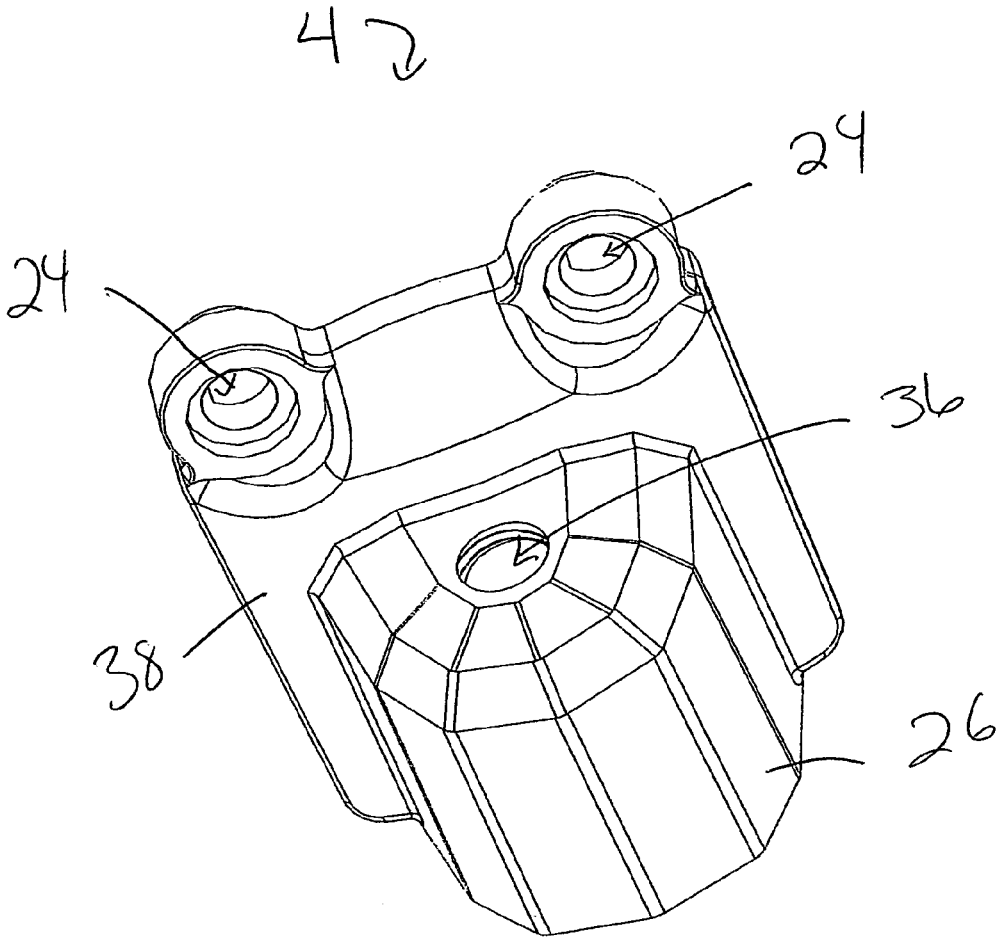
FIG. 8 is a top perspective view of the housing in the most preferred embodiment of the present invention without the clamping member or float switch body attached.
Figure 9:
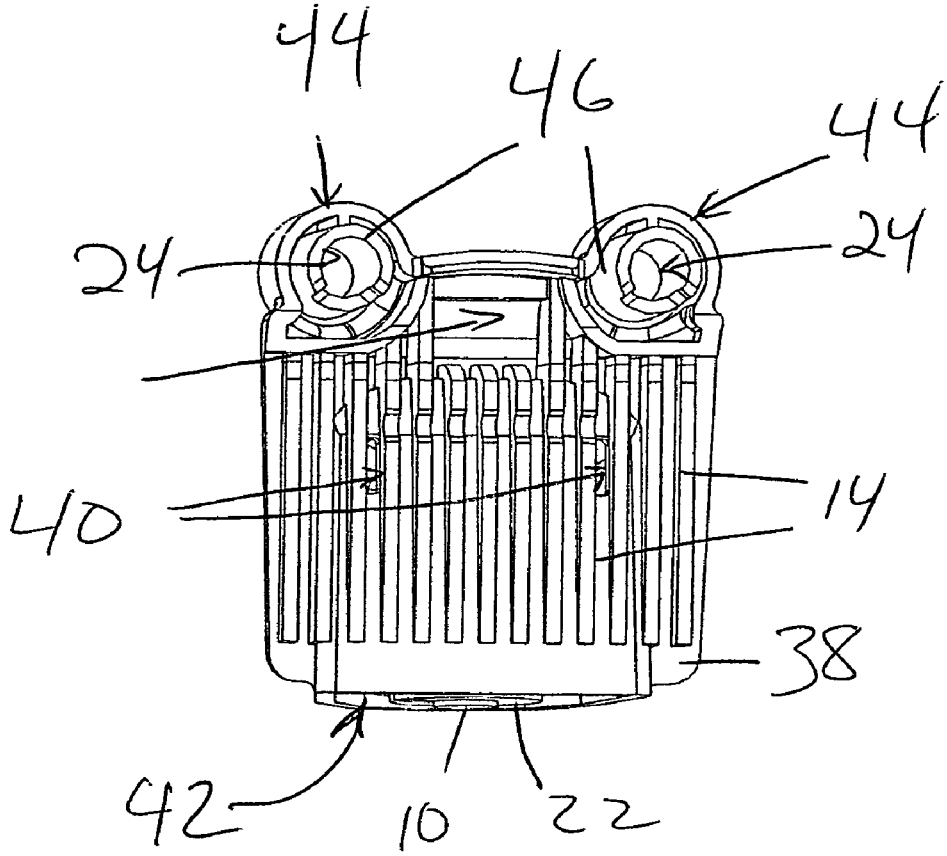
FIG. 9 is a rear view of the housing in the most preferred embodiment of the present invention having many closely spaced-apart and vertically extending ribs, with two centrally located air vent holes through its back surface and an upper structure configured for connection to the clamping member.
Figure 10:
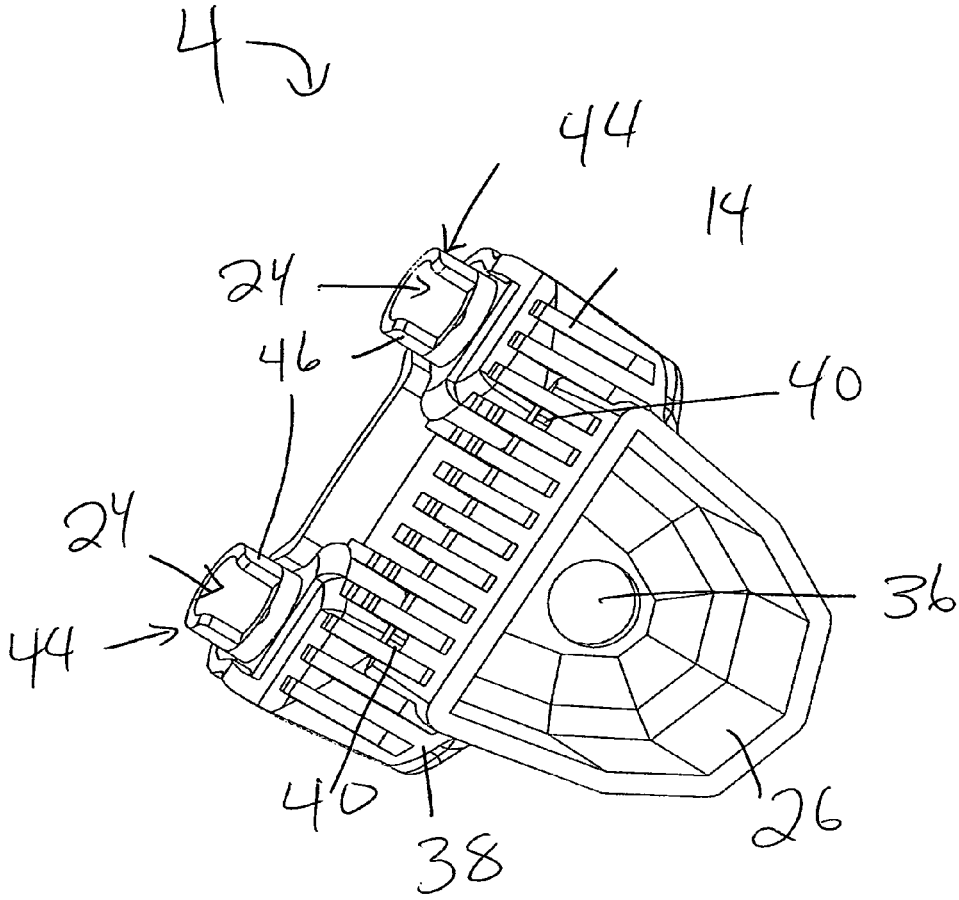
FIG. 10 is a bottom view of the housing in the most preferred embodiment of the present invention without a float switch body or clamping member attached.
Figure 11:
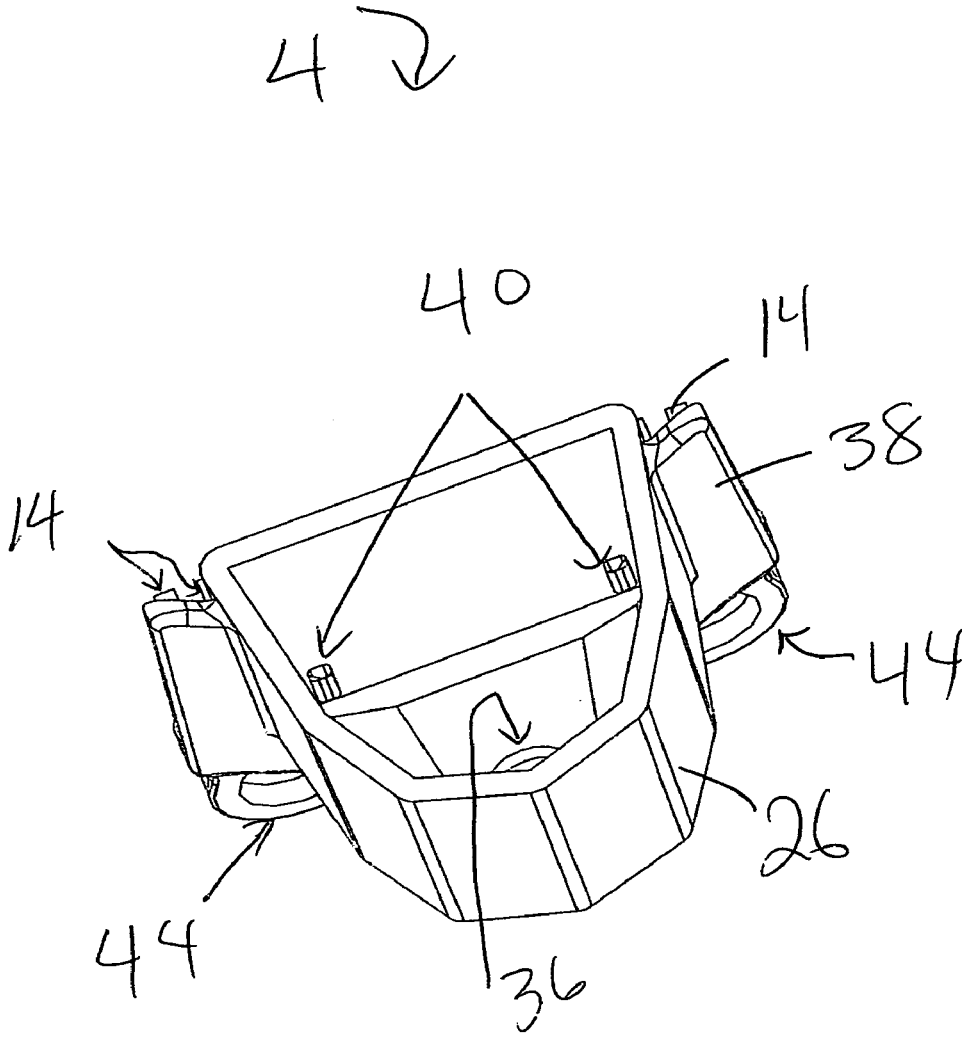
FIG. 11 is a bottom perspective view of the housing in the most preferred embodiment of the present invention with the float switch body removed to make its two air vent holes readily visible.

FIGS. 8–11 further show the most preferred embodiment of the present invention housing 4 in greater detail. FIG. 8 shows housing 4 having a forward-extending half-dodecagon configuration 26, a substantially rectangular rear portion 38 rearwardly depending from half-dodecagon configuration 26, and rear portion 38 having two substantially circular laterally spaced-apart connecting members 44 each with an opening 24 therethrough that are positioned above half-dodecagon configuration 26 and used in the connection of housing 4 to clamping member 6. In addition, FIG. 8 shows a threaded opening 36 centrally through the top surface of half-dodecagon configuration 26. FIG. 9 shows the side of rear portion 38 remote from half-dodecagon configuration 26. A plurality of spaced-apart strength-enhancing ribs 14 extend across half-dodecagon configuration 26 and rear portion 38. Also, two spaced-apart air vents 40 are shown centrally through the back wall of half-dodecagon configuration 26. Air vents 40 are used for the escape of air from half-dodecagon configuration 26 to prevent airlock malfunction of float switch body 18 as water fills half-dodecagon configuration 26 through its open bottom end 42. The number, configuration, size, spacing, surface structure, and coverage of ribs 14 relative to rear portion 38 can be different than that shown in FIG. 9 and would be determined according to the strength requirements appropriate to the needed application. The size, number, spacing, and shape of air vents 40 would also be determined according to the needed application. Stop 22 and the lowermost portion of shaft 10 are visible through open bottom end 42. Connecting members 44 can also have a configuration different from that shown in FIG. 9, however, the rearward extensions 46 are preferred for enhancing a secure connection between housing 4 and clamping member 6 after installation. The rectangular configuration marked by the number 60 in FIG. 9, and which is positioned between connecting members 44, could also contain an additional connecting member 44 or other connection means for assisting in the securing of housing 4 to clamping member 6 during use. FIG. 10 shows the threaded opening 36 centrally through the top surface of half-dodecagon configuration 26, as well as the ribs 14 depending rearwardly from the rear wall of half-dodecagon configuration 26 and rear portion 38. Two centrally located and spaced-apart air vents 40 are also shown through the rear wall of half-dodecagon configuration 26. FIG. 10 further shows the two substantially circular laterally spaced-apart connecting members 44 through the upper part of rear portion 38, each with an opening 24 therethrough and a rearward extension 46. Although the configuration of connecting members 44 shown in FIGS. 8–10 is preferred, it is also considered to be within the scope of the present invention from connecting members of differing number and configuration to be used. FIG. 11 shows the preferred positioning of air vents 40 through the back wall of half-dodecagon configuration 26, the threaded opening through the upper surface of half-dodecagon configuration 26, and a portion of the connecting members 44 and ribs 14 associated with rear portion 38. Float switch body 18, shaft 10, and stop 22 have been removed from FIGS. 10 and 11 so that the structure of half-dodecagon configuration 26 can be more clearly seen.

Figure 12:
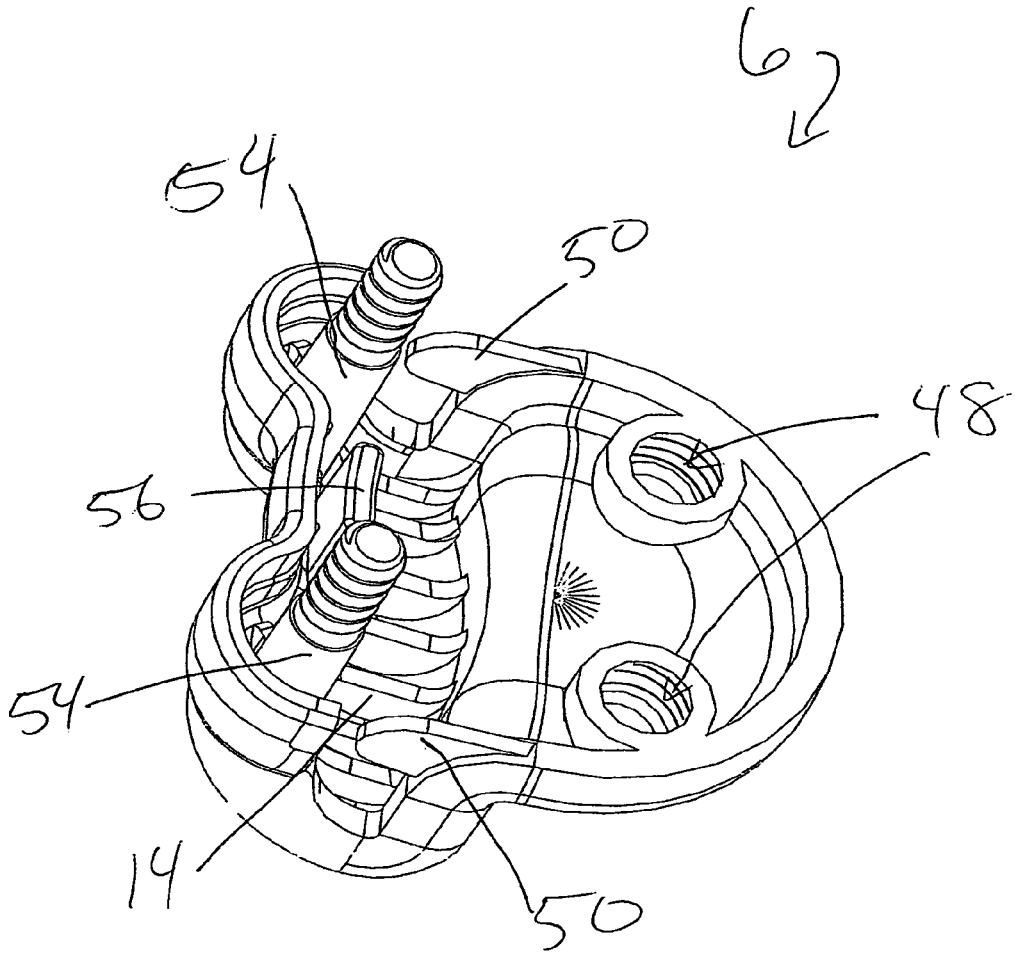
FIG. 12 is a bottom perspective view of the clamping member in the most preferred embodiment of the present invention having a plurality of structural strength-enhancing ribs, two extensions with threaded distal ends for connection of the clamping member to the housing, and two openings for insertion of thumbscrews.
Figure 13:
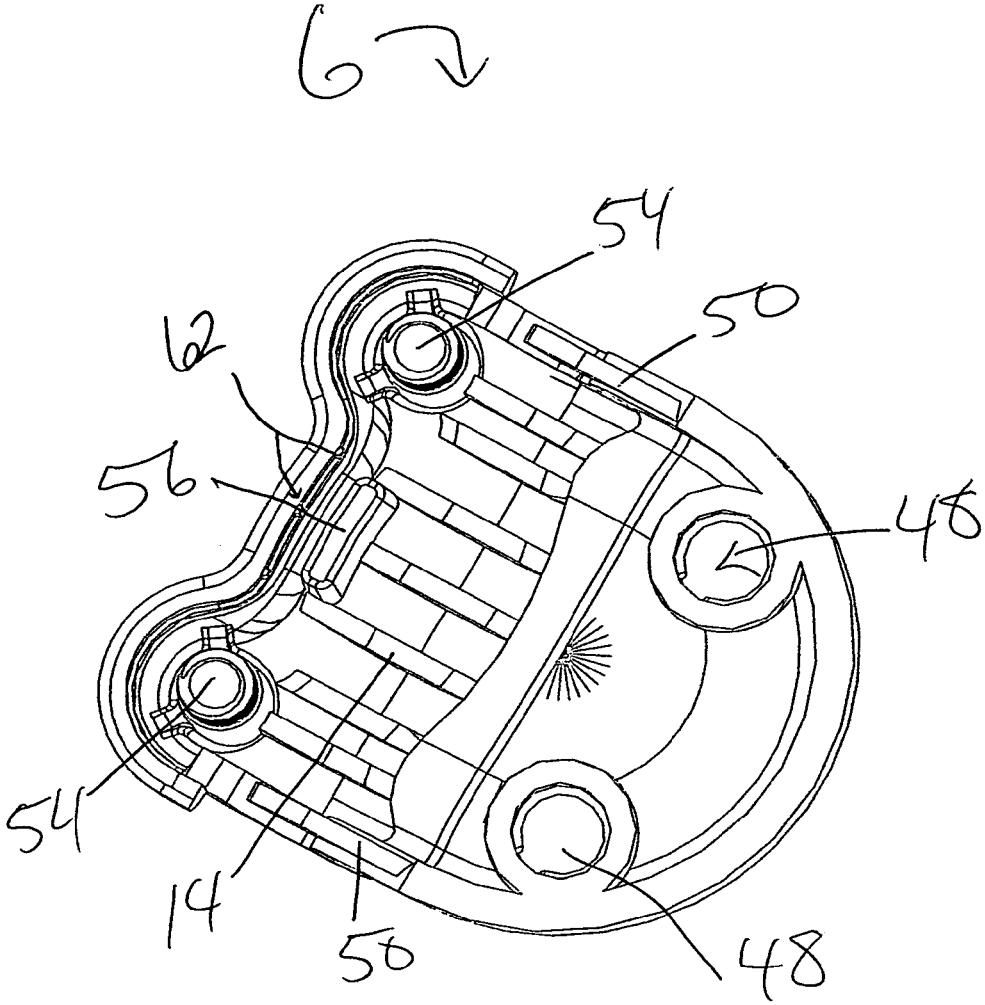
FIG. 13 is a bottom view of the clamping member in the most preferred embodiment of the present invention having a plurality of structural strength-enhancing ribs, two extensions with threaded distal ends for connection of the clamping member with the housing, and two openings for insertion of the thumbscrews.

FIGS. 12 and 13 show clamping member 6 in the most preferred embodiment 2 of the present invention. FIGS. 12 and 13 show clamping member 6 having two threaded openings 48 that guide and engage thumbscrews 28 as they are tightened against a support surface 30, two side projections 50 that assist thumbscrews 28 in retaining the upper portion of a support surface within the J-shaped slot created between housing 4 and clamping member 6 when they are joined together, and the elongated projections 54 with threaded distal ends that are used with nuts 8 to secure housing 4 to clamping member 6. In addition, FIGS. 12 and 13 show a plurality of strength-enhancing ribs 14 between threaded openings 48 and elongated projections 54, and a support tongue 56 to further secure the connection between housing 4 and clamping member 6. FIG. 13 also shows several frictional ribs 62 that provide additional contact with housing 4 for added security in the connection between housing 4 and clamping member 6.

Figure 14:
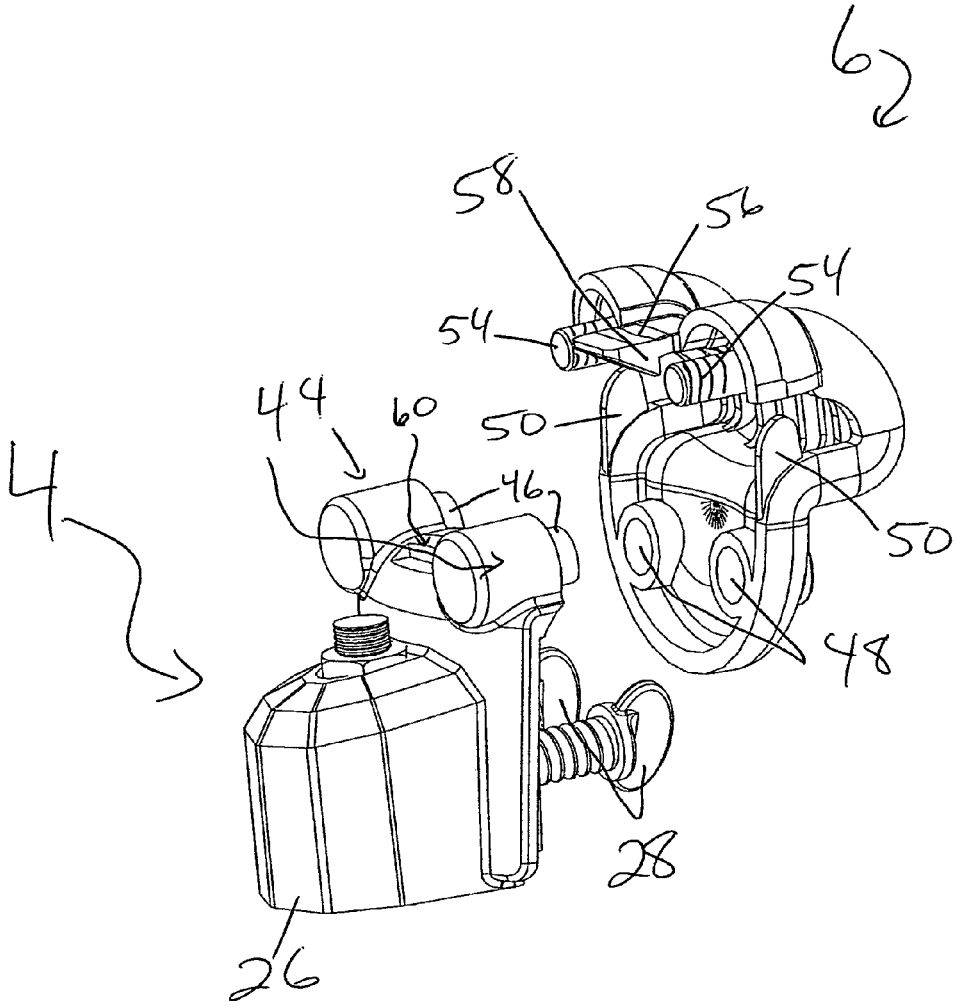
FIG. 14 is a perspective side view of the housing and clamping member in the most preferred embodiment of the present invention having a ratcheting configuration for adjustable connection therebetween.

FIG. 14 shows the alignment of housing 4 and clamping member 6 prior to connection. When housing 4 and clamping member 6 are joined, elongated projections 54 would be inserted through connecting members 44, using rearward extensions 46 as a guide. Thumbscrews 28 would be inserted through threaded openings 48 and tightened against a support surface 30 (not shown in FIG. 14) the upper portion of which is inserted between housing 4 and clamping member 6. Should the upper portion of a plastic condensate pan or other support surface have an arcuate outwardly extending flange (such as flange 16 in FIG. 16), side projections 50 would assist in retaining such a flange within the J-shaped slot between housing 4 and clamping member 6. The connection between housing 4 and clamping member 6 is such that the thumbscrews 28 become positioned outside of any condensate collection pan 30, with half-dodecagon configuration 26 positioned for use where the condensate is collected so that the float switch body attached through opening 36 in half-dodecagon configuration 26 can be used for triggering a shut-off signal to prevent further condensate production when a maximum predetermined amount of condensate considered safe has been collected in pan 30. FIG. 14 also shows an optional ratcheting configuration comprising a tooth 58 on the underside of support tongue 56 and a groove 60 that together assist in maintaining housing 4 securely against clamping member 6 during condensate collection. Although only one tooth 58 and one groove 60 are shown, the number and configuration used is not critical and it is contemplated for multiple teeth 58 and/or grooves 60 to be used for adjustable connection of housing 4 and clamping member 6 against pans and/or support surfaces 30 of differing thickness dimensions.

Figure 15:
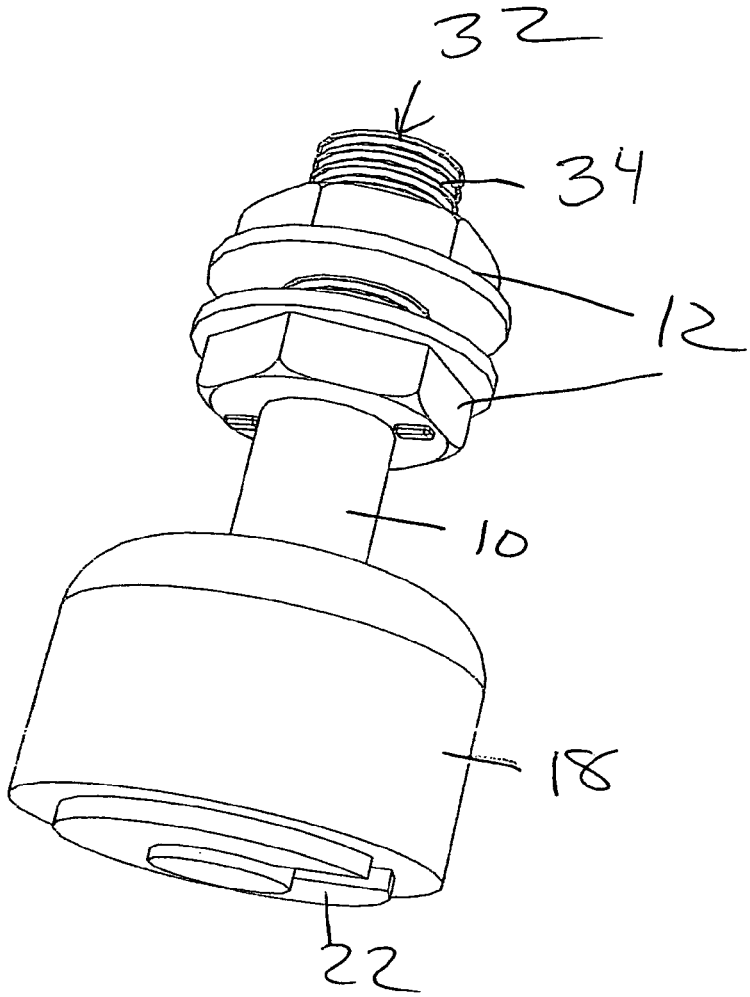
FIG. 15 is a side perspective view of the float switch in the most preferred embodiment of the present invention having a float switch body concentrically positioned around the non-threaded lower portion of a shaft, two lock-nuts secured to the threaded upper portion of the shaft with the lower lock-nut providing the upper boundary of float switch body movement, and a disk-shaped stop secured to the bottom end of the shaft and providing the lower boundary of float switch body movement.

FIG. 15 shows two lock-nuts 12 secured to the upper threaded portion 34 of shaft 10. Lock-nuts 12 are used to secure shaft 10 centrally within housing 4. When the upper threaded portion 34 of shaft 10 is inserted through threaded opening 36 in the preferred half-dodecagon configuration 26 of housing 4, one lock-nut 12 is secured to upper threaded portion 34 within half-dodecagon configuration 26 and the other lock-nut becomes secured to upper threaded portion 34 outside of half-dodecagon configuration 26. Further, when float switch body 18 is concentrically positioned around shaft 10 for free longitudinal movement along shaft 10 and so that shaft 10 can be used as a guide for float switch body 18 during it up and down movement in response to changing water levels in condensate pan 30, and a disk-shaped stop 22 is attached to the bottom end of shaft 10, stop 22 and the lower lock-nut 12 that is inside half-dodecagon configuration 26 then define the limits of vertical movement for float switch body 18. It is contemplated for float switch body to be wide and substantially fill the interior of half-dodecagon configuration 26 for responsive and reliable operation.

Figure 16:
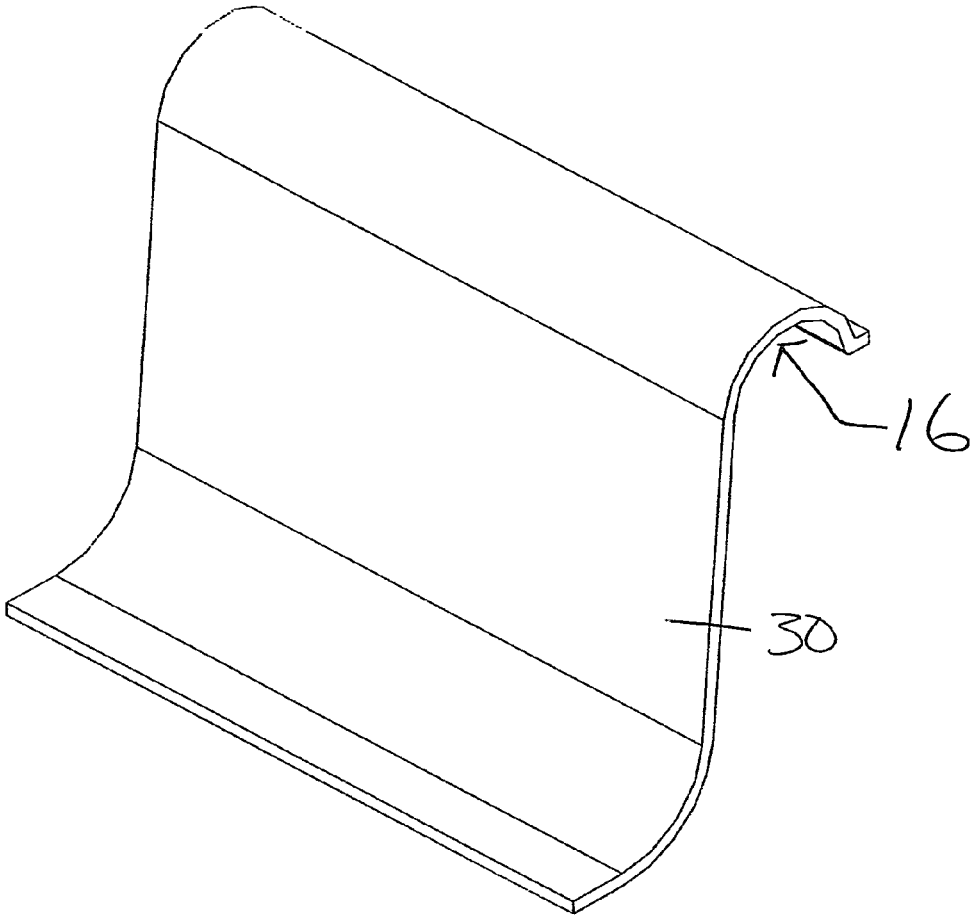
FIG. 16 is a front perspective view of the upper portion of one possible configuration of support surface that could be used with the most preferred embodiment of the present invention.

FIG. 16 shows one possible configuration of support surfaces 30 contemplated for use in association with preferred embodiment 2, such as but not limited to the upstanding wall of a condensate collection pan. The configuration of clamping member 6 accommodates the arcuate flange 16 so as to assist in retaining it in a fixed position relative to housing 4 when clamping member 6 and housing 4 are joined. Although preferred embodiment 2 can be used with a plastic condensate pan having a configuration similar to that shown in FIG. 16, due to its thumbscrews 28, elongated threaded projections 54, and optional tooth 58 and groove 60 ratcheting feature, it is also contemplated for preferred embodiment 2 and other embodiments of the present invention to be usable with other configurations of support surface 30, including support surfaces 30 having flanges 16 with configurations/curvature different from that shown in FIG. 16. In the alternative, groove or grooves 60 could be associated with clamping member 6 and tooth or teeth 58 could be associated with housing 4.

Figure 17:
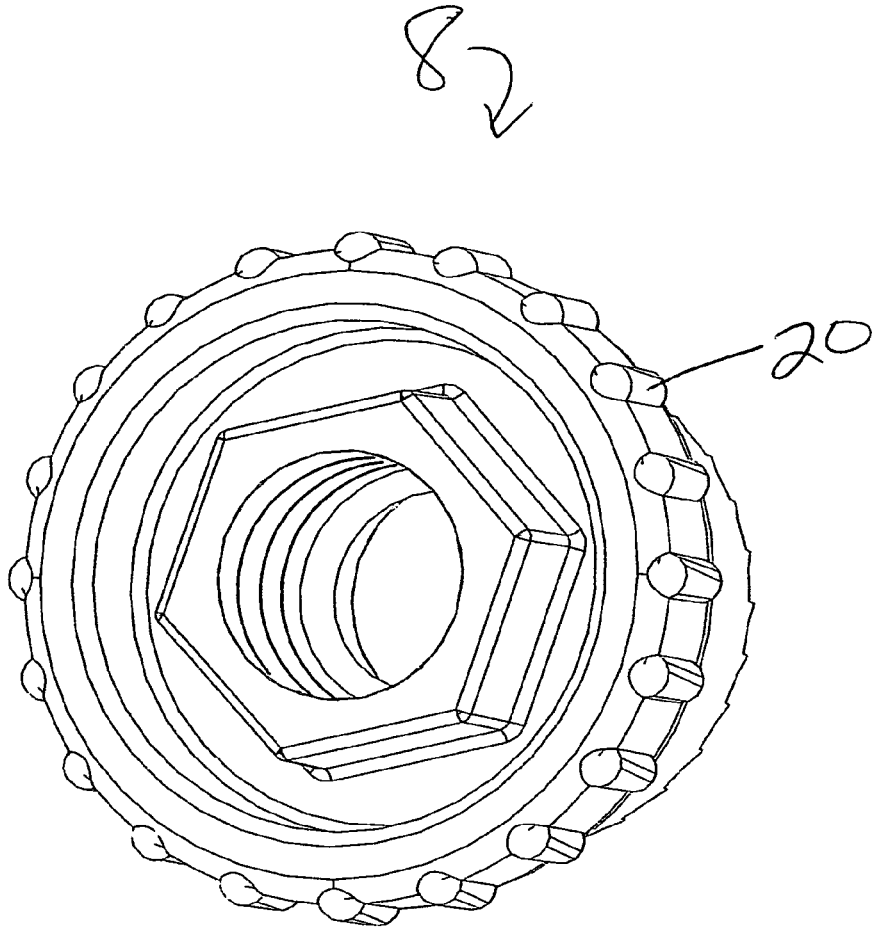
FIG. 17 is a top perspective view of a preferred configuration of nut that is used in the most preferred embodiment of the present invention used to secure housing and clamping member together.
Figure 18:
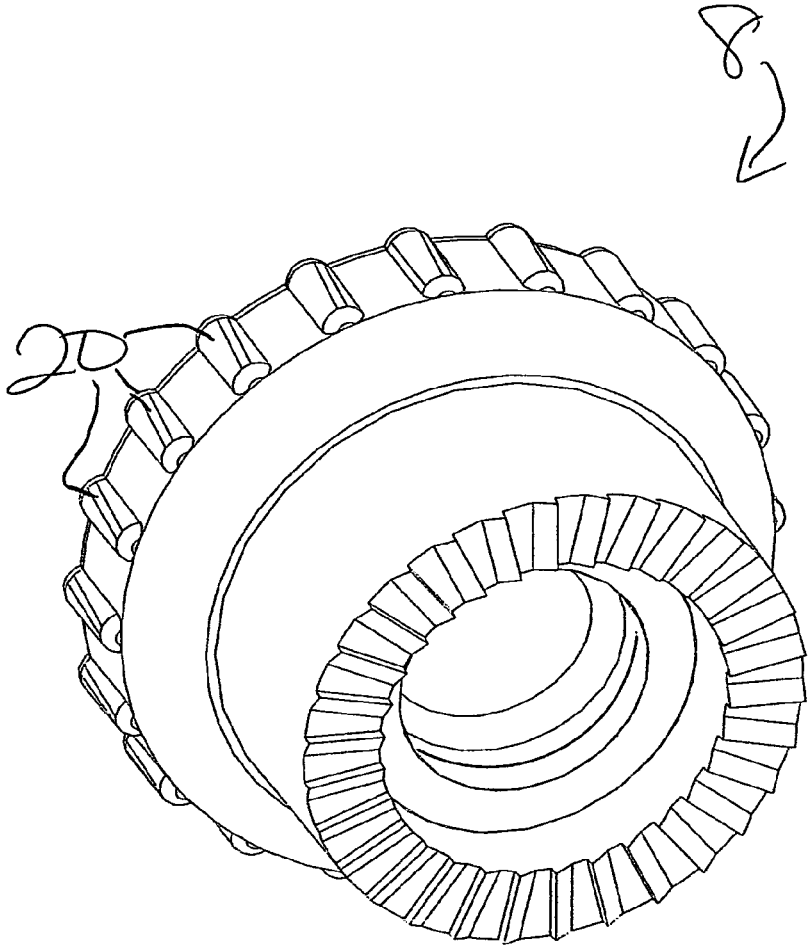
FIG. 18 is a bottom perspective view of the same preferred configuration of nut shown in FIG. 11.
Figure 19:
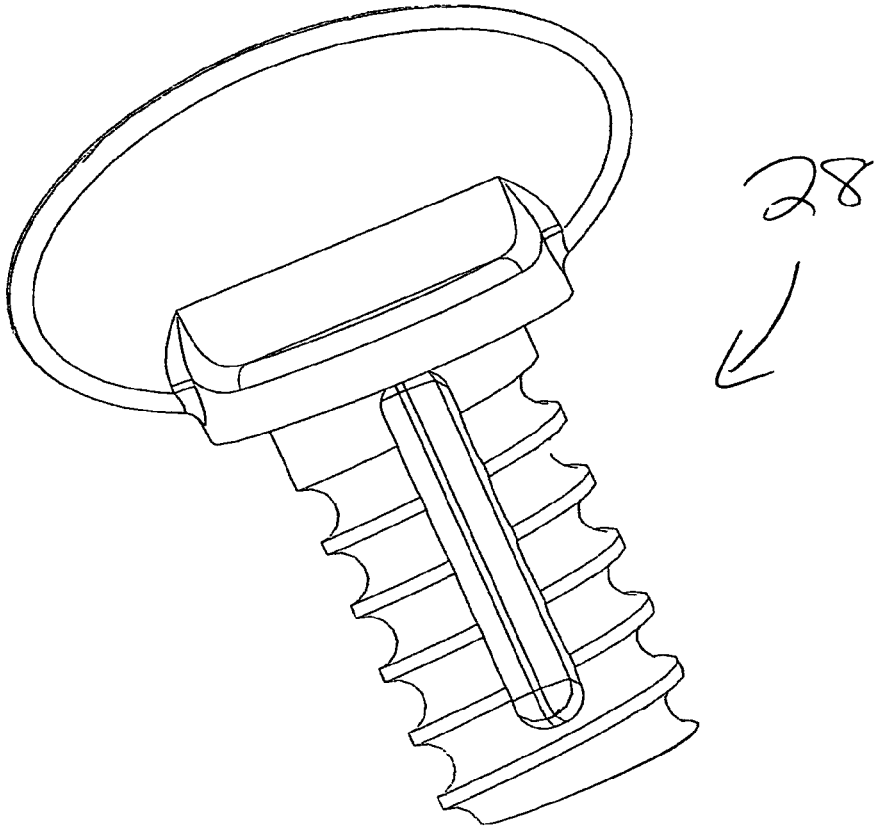
FIG. 19 is a back view of a preferred configuration of thumbscrew that is used in the most preferred embodiment of the present invention.
Figure 20:
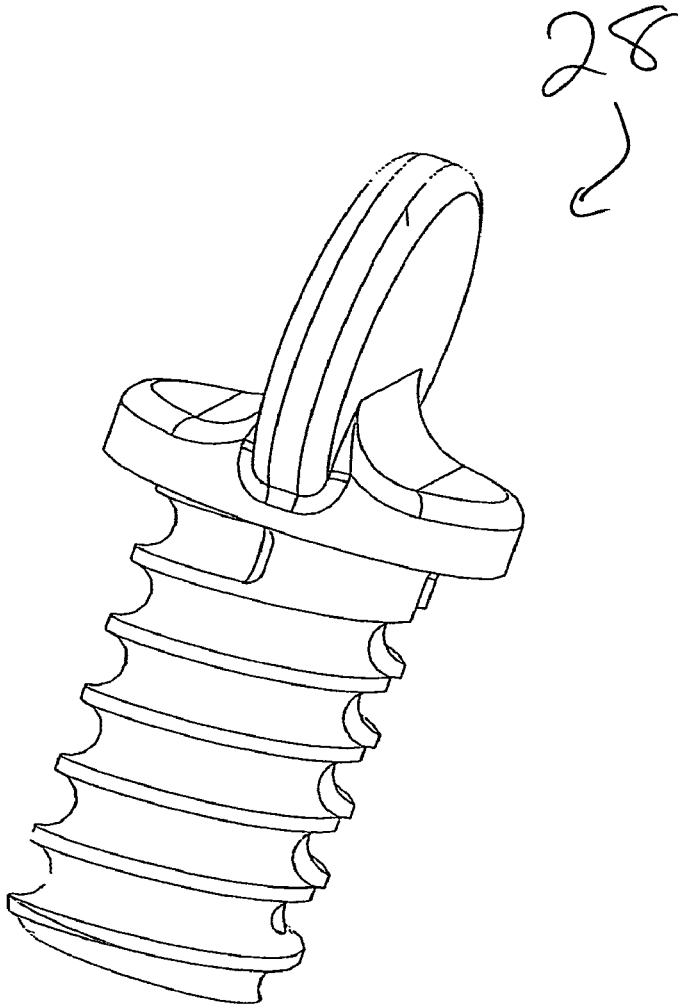
FIG. 20 is a side view of the same preferred configuration of thumbscrew shown in FIG. 13.

FIGS. 17–20 enlarged views of fasteners preferred for the present invention, however, it is also contemplated for other sizes and configurations to also be used. FIGS. 17 and 18 show a preferred nut 8 used in the most preferred embodiment of the present invention to engage threaded elongated projections 54 and thereby secure housing 4 and clamping member 6 together above half-dodecagon configuration 26. Although not critical, it is preferred that nuts 8 have an outer configuration with easily gripped protrusions 20 that allow it to be easily picked up and manipulated during installation. The number of easily gripped projections can vary in number, size, and configuration from that shown in FIGS. 17 and 18. FIGS. 19 and 20 show a preferred thumbscrew 28 used in the most preferred embodiment 2 of the present invention. Although the use of thumbscrews 28 is preferred, other conventional fastening means (not shown) can also be used. Further, the number of thumbscrews 28 used, as well as their size and positioning, are not critical as long as secure attachment of clamping member 6 and housing 4 to the support surface 30 is achieved so as to indefinitely sustain half-dodecagon configuration 26 and its associated float switch body 18 in its original level orientation without unneeded material expense. The number of thumbscrews 28 should be determined by the number needed for secure positioning of clamping member 6 without unnecessary material expense. The thumbscrew 28 shown in FIGS. 19 and 20 are oversized relative to clamping member for easy of use, however, the size relative to clamping member 6 can be varied from that shown. Thumbscrews 28 should be sufficiently large for easy and confident manipulation by an adult human hand (not shown) for prompt installation of housing 4 and clamping member 6 to a support surface 30.

The materials from which the most preferred embodiment 2 is made can vary, but must be impervious to corrosion. Preferably for cost considerations, although not limited thereto, it is contemplated for housing 4, float switch body 18, stop 22, clamping member 6, thumbscrews 28, shaft 10, and lock-nuts 12 to all be made from plastic. Resistance to UV radiation is not necessarily a contemplated feature of the present invention, unless dictated by the application. Manufacture of the present invention could be accomplished by blow molding, injection molding, assembly of pre-formed individual components, or a combination thereof, with the choice of manufacturing being determined by the anticipated purchase cost to consumers and the expected duration of use without maintenance, parts replacement, or repair. Although size of the present invention is not critical, for many condensate collection applications, the length, width, and height dimensions of the combined housing 4 and clamping member 6 would be less than three inches, and in some applications the width of half dodecagon configuration 26 would be no larger than one-and-one-fourth inches.

Prior to use of the most preferred embodiment of the present invention, float switch body 18 would be positioned on shaft 10 so that lead wires 38 extend through top end 32. Preferably, the upper threaded portion 34 of shaft 10 would then be inserted through threaded opening 36 and secured to the top surface of half-dodecagon configuration 26 with the two lock-nuts 12 so that the remainder of shaft 10 is vertically extending through half-dodecagon configuration 26 with float switch body 18 substantially filling the interior space defined by half-dodecagon configuration 26. Stop 22 would be fixed to the bottom end of shaft 10 to define the lower boundary of float switch body 18 movement vertically along shaft 10 during use. Coarse adjustment of the needed vertical displacement of float switch body 18 would be accomplished by repositioning stop 22, lock-nuts 12, or both, on shaft 10. Half-dodecagon configuration 26 may completely, or only substantially, cover float switch body 18. To facilitate installation, it is contemplated that thumbscrews 28 would already be attached to clamping member 6. Thus, it is contemplated that all an operator/installer would have to do is place clamping member 6 against the outside surface of a support member or condensate collection pan 30 with threaded elongated projections 54 positioned above the upper edge of support member or condensate collection pan 30, place housing 4 against the inside surface of the same support member or condensate collection pan 30 with connecting members 44 positioned above the upper edge of support member or condensate collection pan 30, and while using the rearward extensions 46 as a guide, inserting elongated projections 54 through the central openings 26 connecting members 44 and using nuts 8 to tighten housing 4 against clamping member 6. When the ratcheting configuration of teeth 58 and grooves 60 is present, it too can be used to further tighten housing 4 against clamping member 6. Thereafter, thumbscrews 28 would be tightened to further secure clamping member 6 against the outside surface of the support member or condensate collection pan 30 to further stabilize the positioning of housing 4 during use for reliable vertical movement of float switch body 18 within half-dodecagon configuration 26. No drilling of holes through the upstanding wall of container or pan 30 is required. Once housing 4 is in its secured and usable position, the installer or operator would check it for the stable and level positioning required for reliable and uninhibited vertical movement of float switch body 18. Lead wires 38 would then be connected to the system providing water or other fluid collected by container or pan 30. Then, when collected fluid fills container or pan 30 beyond a pre-determined depth that is considered to be safe to prevent overflow, the present invention float switch body 18 is lifted by the rising fluid to the height that interrupts the system's operation and stop additional fluid collection in container or pan 30. As fluid rises in container or pan 30, the air vent openings 14 through the rear portion of housing 4 prevent the creation of an airlock within the interior of half-dodecagon configuration 26 that could potentially interfere with the proper vertical movement of float switch body 18. Minimal maintenance is contemplated. Housing 4 would protect the movement of float switch body 18 from interference due to airborne debris (not shown), such as the fibers found in attic insulation. If housing 4 is made from translucent, transparent, or partially transparent materials, an operator could visibly assess the effective operation of float switch body 18 without removing it from housing 4 or separating clamping member 6 from container or pan 30. The size, configuration, and pattern of air vent openings 14 and thumbscrews 28 are not critical and can vary depending upon design and price point considerations, such as but not limited to ease of manufacture and effectiveness of operation. It is further contemplated for housing 4, clamping member, and thumbscrews 28 to have a compact design and construction for efficient packaging and transport

I claim:

1. A float switch and clamping member assembly for use in association with a fluid collection container having a top edge to shut off a system providing fluid to the container once a pre-determined fluid depth has been reached, said assembly comprising:

a housing having a front portion with an interior space, an open bottom end, a rear wall, at least one air vent opening through said rear wall, and a threaded bore centrally through said top, said housing also having a rear portion with at least two upper connecting members;

at least one thumbscrew;

a clamping member configured for creating a substantially J-shaped slot between said rear portion of said housing and said clamping member when they are joined during use, said clamping member also having at least one threaded opening therethrough that is configured for engagement of said at least one thumbscrew, said clamping member further having an upper connection means engaging with said at least two upper connecting members of said housing;

at least two fasteners adapted for securely fixing said connection means of said clamping member and said at least two upper connecting members of said housing to one another;

a shaft with a threaded top portion secured within said threaded bore in said top surface of said housing, said shaft also having a bottom end with a stop;

a float switch body concentric with said shaft and positioned for free movement along said shaft;

fastening means securely attaching said shaft to said housing; and lead wires connected between said float switch body and the system providing fluid to the collection container with which said assembly is associated, so that when the top edge of the container is positioned within said J-shaped slot between said clamping member and said housing, said at least two fasteners fixedly secure said upper connecting members of said housing to said connection means of said clamping member and said at least one thumbscrew is tightened in said at least one threaded opening through said clamping member, said float switch body is positioned to move freely along said shaft between said stop and said fastening means in response to rising and falling fluid levels in the attached container, and whereby when a pre-determined maximum depth of fluid accumulation is reached said float switch body shuts off the system to prevent fluid overflow in the container.

2. The assembly of claim 1 wherein said fastening means comprises at least one lock-nut.

3. The assembly of claim 1 wherein said stop is separable from said shaft.

4. The assembly of claim 1 wherein said shaft has a top opening, and further wherein said lead wires are extended through said top opening.

5. The assembly of claim 1 wherein the maximum vertical movement of said float switch body along said shaft is adjustable.

6. The assembly of claim 1 wherein said connection means of said clamping member comprises at least two threaded elongated projections, and said at least two upper connecting members of said housing comprise a rearward projection.

7. The assembly of claim 1 wherein said housing and said clamping member further comprise strength-enhancing ribs.

8. The assembly of claim 1 wherein said housing has a half-dodecagon configuration.

9. The assembly of claim 1 wherein said housing and said clamping members further comprise an additional fastening means with a ratcheting configuration.

10. The assembly of claim 9 wherein said ratcheting configuration comprises at least one tooth and at lease one complementary groove.

11. The assembly of claim 1 wherein said housing has a top surface which is at least partially angled.

12. The assembly of claim 1 wherein said at least two fasteners each comprise a nut configuration.

13. The assembly of claim 12 wherein said fasteners further comprise easily gripping projections.

14. The assembly of claim 1 wherein said clamping member further comprises a support tongue.

* * * * *